US005641295A

United States Patent [19]

Koyama

[11] Patent Number: 5,641,295

[45] Date of Patent: Jun. 24, 1997

[54] MODULAR BOARD ELECTRICAL CONNECTOR

[75] Inventor: Ryozo Koyama, Tokyo, Japan

[73] Assignee: Hirose Electric Co., Ltd., Tokyo, Japan

[21] Appl. No.: 570,992

[22] Filed: Dec. 12, 1995

[30] Foreign Application Priority Data

Jan. 12, 1995 [JP] Japan ..... 7-003579

[51] Int. Cl.[6] ..... H01R 13/62

[52] U.S. Cl. ..... 439/326; 439/541.5

[58] Field of Search ..... 439/59–62, 325, 439/326–329, 541.5, 629–637

[56] References Cited

U.S. PATENT DOCUMENTS

| | | | |
|---|---|---|---|
| 5,030,115 | 7/1991 | Regnier et al. | 439/541.5 X |
| 5,244,403 | 9/1993 | Smith et al. | 439/326 |
| 5,318,452 | 6/1994 | Brennian, Jr. et al. | 439/541.5 X |
| 5,401,182 | 3/1995 | McHugh et al. | 439/326 |

*Primary Examiner*—Khiem Nguyen
*Attorney, Agent, or Firm*—Kanesaka & Takeuchi

[57] ABSTRACT

A modular board electrical connector which includes first and second insulation housings stacked one upon another and having first and second bases with first and second card receiving slots therein and first and second pairs of side walls extending forwardly from opposite ends of the first and second bases and having a latch member on a free end thereof; a plurality of contact elements arranged in the first and second card receiving slots such that when a modular board is inserted into the first or second card receiving slot and turned to a latch position, they are brought into contact with contact pads of the modular board; a pair of support members extending forwardly from opposite ends of each of the card receiving slots along the side walls for supporting the modular board inserted in the card receiving slot; and the latch members of the first insulation housing being retreated from those of the second insulation housing to facilitate diagonal insertion of a modular board into the card receiving slot of the second insulation housing.

3 Claims, 5 Drawing Sheets

MODULAR BOARD ELECTRICAL CONNECTOR

BACKGROUND OF THE INVENTION

1. Field of the Invention

The present invention relates to modular board electrical connectors to which modular boards with contact pads arranged thereon are connected with low insertion forces and particularly to a modular board electrical connector with a latch, to which a modular board is inserted and then turned to a latch position where the modular board is latched to the electrical connector.

2. Description of the Related Art

Modular board electrical connectors of this type are mounted on printed circuit boards as mother boards. Card-like modular boards as daughter boards are connected to such modular board electrical connectors thereby connecting the modular boards to the mother boards. As the density of ICs mounted increases, there is a need for more mounting areas in the mother boards. In order to compensate for this need, it has been proposed to mount more modular boards on the mother boards.

In order to meet such a need, there have been proposed modular board electrical connectors which allows connection of a plurality of modular boards stacked one upon another to a mother board. An example of such electrical connectors is a double stack horizontal mount card edge connector. This card edge connector is mounted on a mother board horizontally and allows connection of two modular boards one upon another to the mother board.

Such a double stack horizontal mount card edge connector makes double the mounting areas of conventional single stack modular electrical connectors thus remarkably increasing the mounting areas of mother boards.

However, there are some problems with the double stack modular boards electrical connectors to which modular boards are inserted in a diagonal direction and then turned to a latch position. That is, if two single stack modular board electrical connectors are merely stacked, the upper latch members of the upper electrical connector become obstacles to a modular board to be inserted into the lower electrical connector in a diagonal direction. If the upper electrical connector is raised from the lower one to avoid this problem, the resulting electrical connector fails to meet the low-profile compact configuration requirement.

SUMMARY OF THE INVENTION

Accordingly, it is an object of the invention to provide a compact modular board electrical connector which allows connection of modular boards with high density.

According to the invention there is provided a modular board electrical connector which includes first and second insulation housings stacked one upon another and having first and second bases with first and second card receiving slots therein and first and second pairs of side walls extending forwardly from opposite ends of the first and second bases and having a latch member on a free end thereof; a plurality of contact elements arranged in the first and second card receiving slots such that when a modular board is inserted into the first or second card receiving slot and turned to a latch position, they are brought into contact with contact pads of the modular board; a pair of support members extending forwardly from opposite ends of each of the card receiving slots along the side walls for supporting the modular board inserted in the card receiving slot; and the latch members of the first insulation housing being disposed closer to the first card receiving slot than the latch members of the second insulation housing to the second card receiving slot.

According to a preferred embodiment of the invention, the second side walls includes a fixed arm; a first flexible arm extending along the fixed arm; a second flexible arm extending inwardly and then rearwardly from the first flexible arm and supporting the second latch member, and the first side walls includes a fixed arm; and a third flexible arm extending along the fixed arm for supporting the first latch member.

According to another preferred embodiment of the invention, the card receiving slot and the support member of the first insulation housing are retreated from those of the second insulation housing.

According to still another preferred embodiment of the invention, the support members of the first insulation housing have a tapered surface facing the second card receiving slot.

The above and other objects, features, and advantages of the invention will be more apparent from the following description when taken in conjunction with the accompanying drawings.

DESCRIPTION OF THE PREFERRED EMBODIMENT

Figure 1:
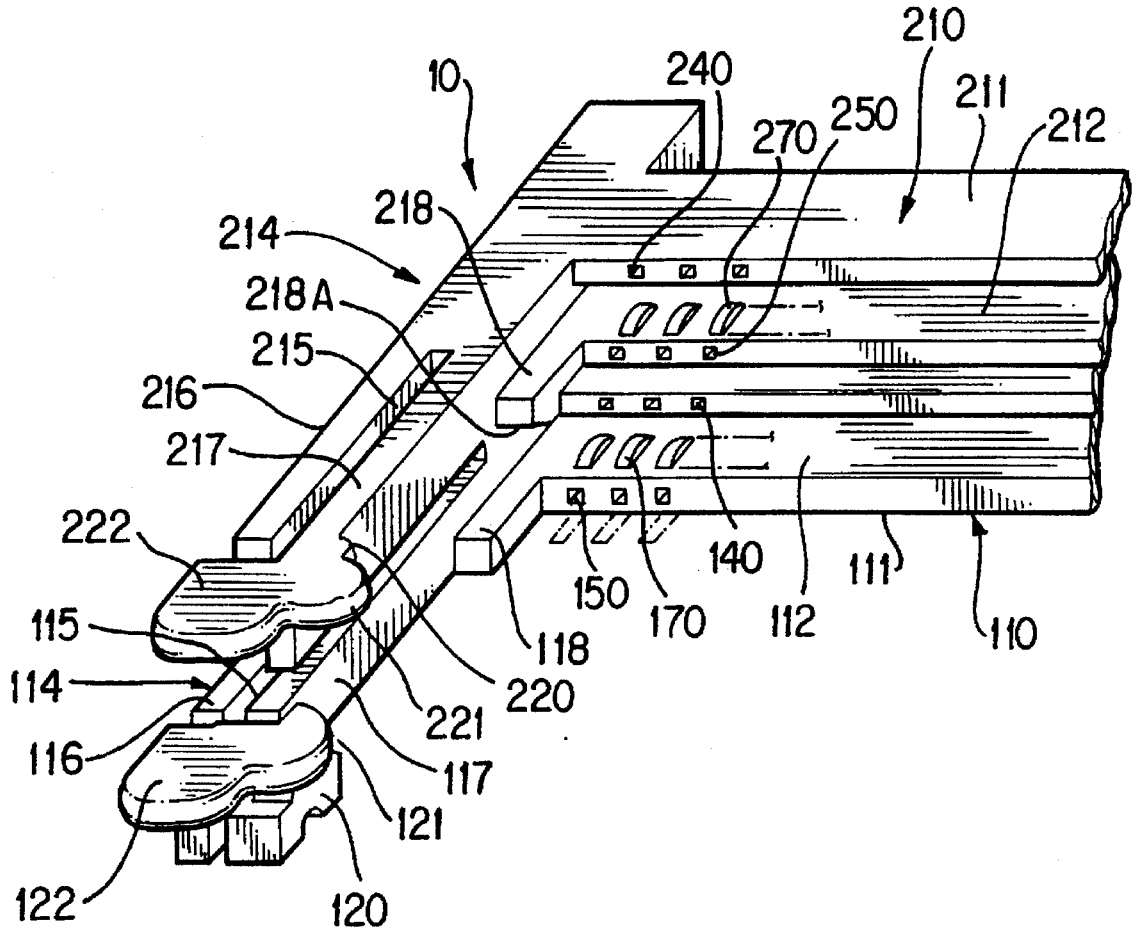
FIG. 1 is a perspective view of a left half of a modular board electrical connector according to an embodiment of the invention.

In FIG. 1, a modular board electrical connector 10 according to an embodiment of the invention includes an insulation housing which is integrally molded from an insulation material, such as a plastic, so as to provide a rear (lower) housing 110 and a front (upper) housing 210. The lower housing 110 includes a lower base 111 with a card receiving slot 112 and a pair of side walls 114 extending forwardly from opposite ends of the base 111. Similarly, the upper housing 210 includes an upper base 211 with a card receiving slot 212 and a pair of side walls 214 extending forwardly from opposite ends of the base 211.

A front portion of each lower side wall 114 is divided by a slit 115 into an outer fixed arm 116 and an inner first flexible arm 117. A second flexible arm 120 extends first inwardly and then rearwardly from a front portion of the first flexible arm 117. A latch tab 121 is provided on the top of the second flexible arm 120, and an operation lever 122 extend forwardly from the latch tab 121. The first flexible arm 117, the second flexible arm 120, and the latch tab 121 constitute a latch member for latching a modular board in the card receiving slot 112. A pair of support members 118 are provided on the inner surfaces of the side walls 114 for supporting opposite sides of a modular board being connected into the card receiving slot 112.

A front portion of each upper side wall 214 is divided by a slit 215 into an outer fixed arm 216 and an inner third flexible arm 217. A projection 220 and a latch claw 221 are provided on a front end of the third flexible arm 217, and an operation lever 222 extends forwardly from the latch claw 221. The third flexible arm 217, the projection 220, and the latch claw 221 constitute a latch member for latching a modular board in the card receiving slot 212. A pair of support members 218 are provided on the inner surfaces of the side walls 214 for supporting a modular board being connected into the card receiving slot 212. The support member 218 has a tapered surface 218A facing the lower card receiving slot 112.

Figure 2:
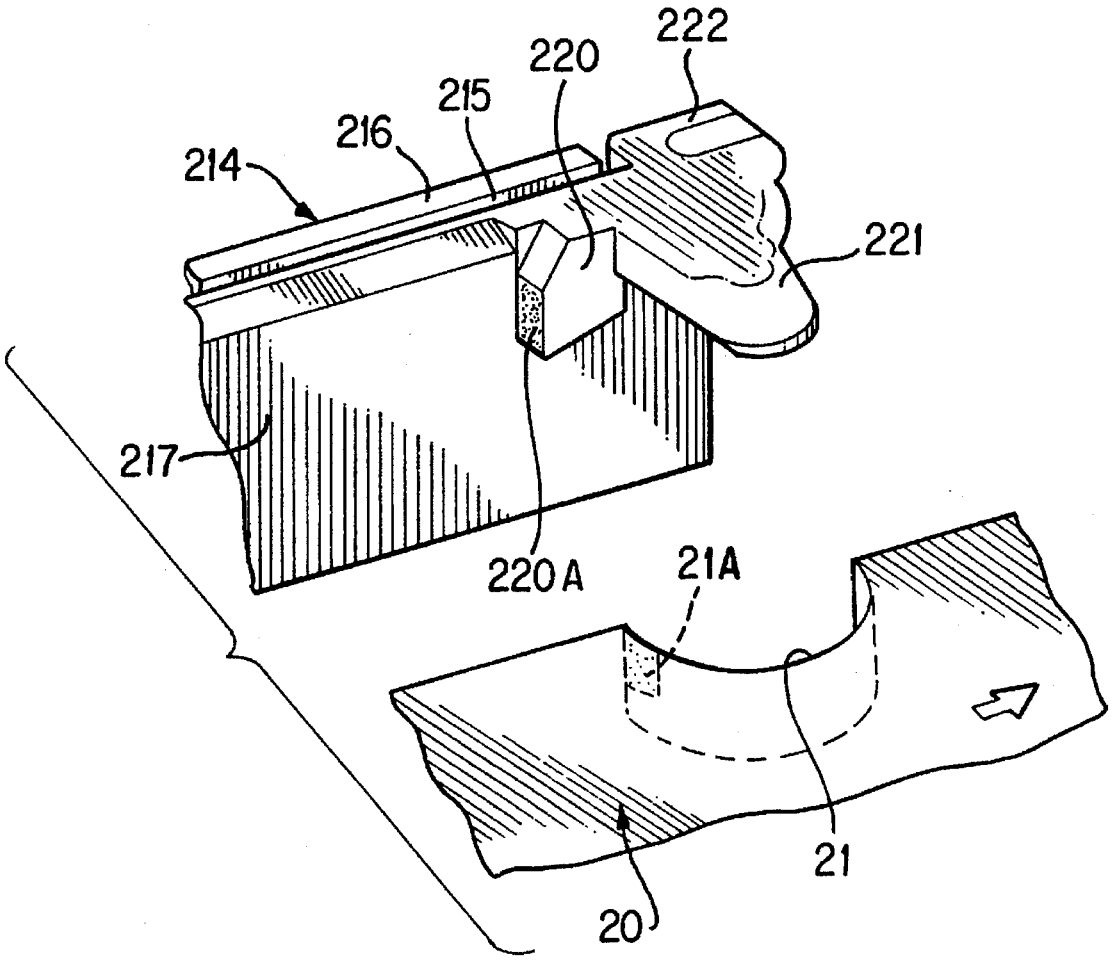
FIG. 2 is a perspective view of an upper right side wall of the modular board electrical connector and part of a modular board.

In FIG. 2, the modular board 20 to be connected to one of the card receiving slots 112 and 212 of a double stack modular board electrical connector 20 is a card-like printed circuit board on which a variety of electronic components, such as ICs, are mounted. Other examples of the modular board include large size IC cards. A number of contact pads (not shown) are arranged at regular intervals on both surfaces of a front edge portion of the modular board 20. The contact pads on the top side are offset by a half pitch from those of the back side. A notch 21 is provided on each side edge of the modular board 20. The rest of the modular board may be conventional and will not be described in any more detail.

When the modular board 20 is latched in the card receiving slot 212 of the upper housing, a retainer projection 220 provided on the front end of the third flexible arm 217 fits into the notch 21 of the modular board 20. When a force is applied to the modular board 20 tending to pull it out of the card receiving slot 212, the retention surface 220A of the projection 220 abuts against an abutment surface 21A of the notch 21 thereby preventing the modular board 20 from coming out of the card receiving slot 212.

Figure 3:
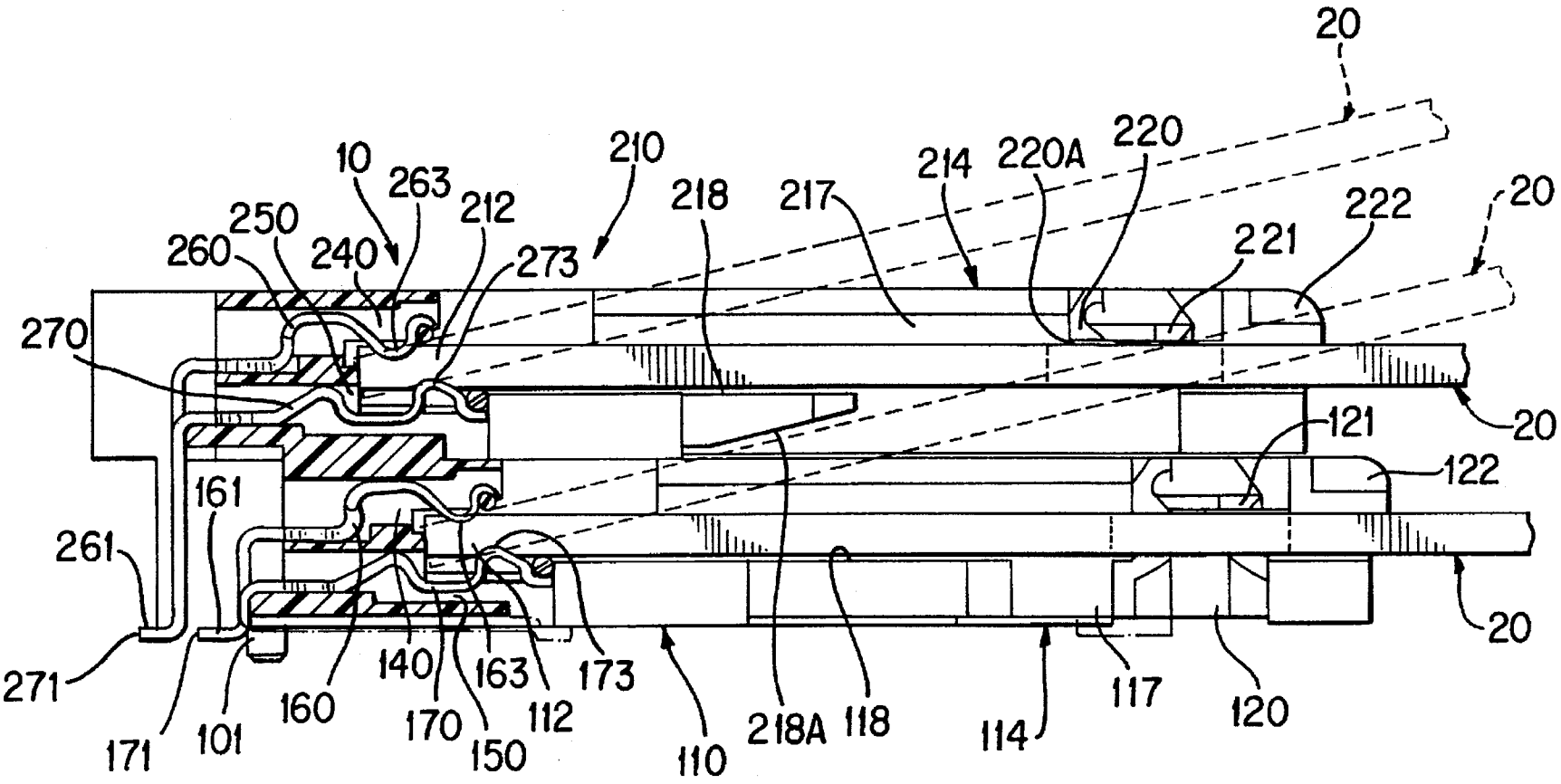
FIG. 3 is a sectional view of the modular board electrical connector with two modular boards are connected.

In FIG. 3, a number of upper contact element receiving slots 140 are arranged in a top wall of the card receiving slot 112 of the lower housing 110 with a pitch equal to that of the contact pads on the top side of the modular board 20. Similarly, a number of contact receiving slots 150 are arranged in a bottom wall of the card receiving slot 112 with a pitch equal to that of the contact pads on the back side of the modular board 20.

First type contact elements 160 are arranged in the upper contact receiving slots 140 while second type contact elements 170 are arranged in the lower contact receiving slots 150. The first type contact elements 160 are made by stamping, rolling and bending from a spring conductive sheet material. The second type contact elements 170 are made independently from the first type contact elements 160 by stamping, rolling, and bending from a spring conductive sheet material.

A number of upper contact receiving slots 240 are provided in the top wall of the card receiving slot 212 of the upper housing 210 with a pitch equal to that of the contact pads on the top side of the modular board 20. Similarly, a number of contact receiving slots 250 are provided in a bottom wall of the card receiving slot 212 with a pitch equal to that of the contact pads on the back side of the modular board 20.

First type contact elements 260 are arranged in the upper contact receiving slots 240 while second type contact elements 270 are arranged in the lower contact receiving slots 250. The first type contact elements 260 are made by stamping, rolling, and bending from a spring conductive sheet material. The second type contact elements 270 are made independently from the first type contact elements 260 and, similarly, by stamping, rolling, and bending from a spring conductive sheet material.

The first type contact elements 160 arranged in the upper contact receiving slots 140 are bent so as to provide such a configuration as shown in FIG. 3. That is, they have a connection section 161 for connection to a corresponding conductor of a mother board (not shown) on which the electrical connector 10 is mounted and a contact section 163 for contact with a corresponding contact pad of the modular board 20. The second type contact elements 170 of a configuration as shown in FIG. 3 have a connection section 171 and a contact section 173.

The first type contact elements 260 arranged in the upper contact receiving slots 240 are bent so as to provide such a configuration as shown in FIG. 3 and have a connection section 261 for connection to a corresponding conductor of a mother board (not shown) on which the electrical connector is mounted and a contact section 263 for contact with a corresponding contact pad on the modular board 20. The second type contact elements 270 arranged in the lower contact receiving slots 250 are bent so as to provide such a configuration as shown in FIG. 3 and have a connection section 271 and a contact section 273. The first contact elements 160 in the contact receiving slots 140 and the first contact elements 260 in the contact receiving slots 240 are substantially identical except for lengths to the connection sections 161 and 261, respectively. Similarly, the second type contact elements 170 in the contact receiving slots 150 and the second type contact elements 270 in the contact receiving slots 250 are substantially identical except for lengths to the connection sections 171 and 271, respectively. Alternatively, the connection sections 161 and 171 of the contact elements 160 and 170 may be bent forwardly so as to project forwardly from the bottom of the base 111 of the lower housing 110 as shown by phantom line in FIGS. 1 and 3 thereby making it easy to check the connection conditions to corresponding conductors of a mother board.

Figure 4:
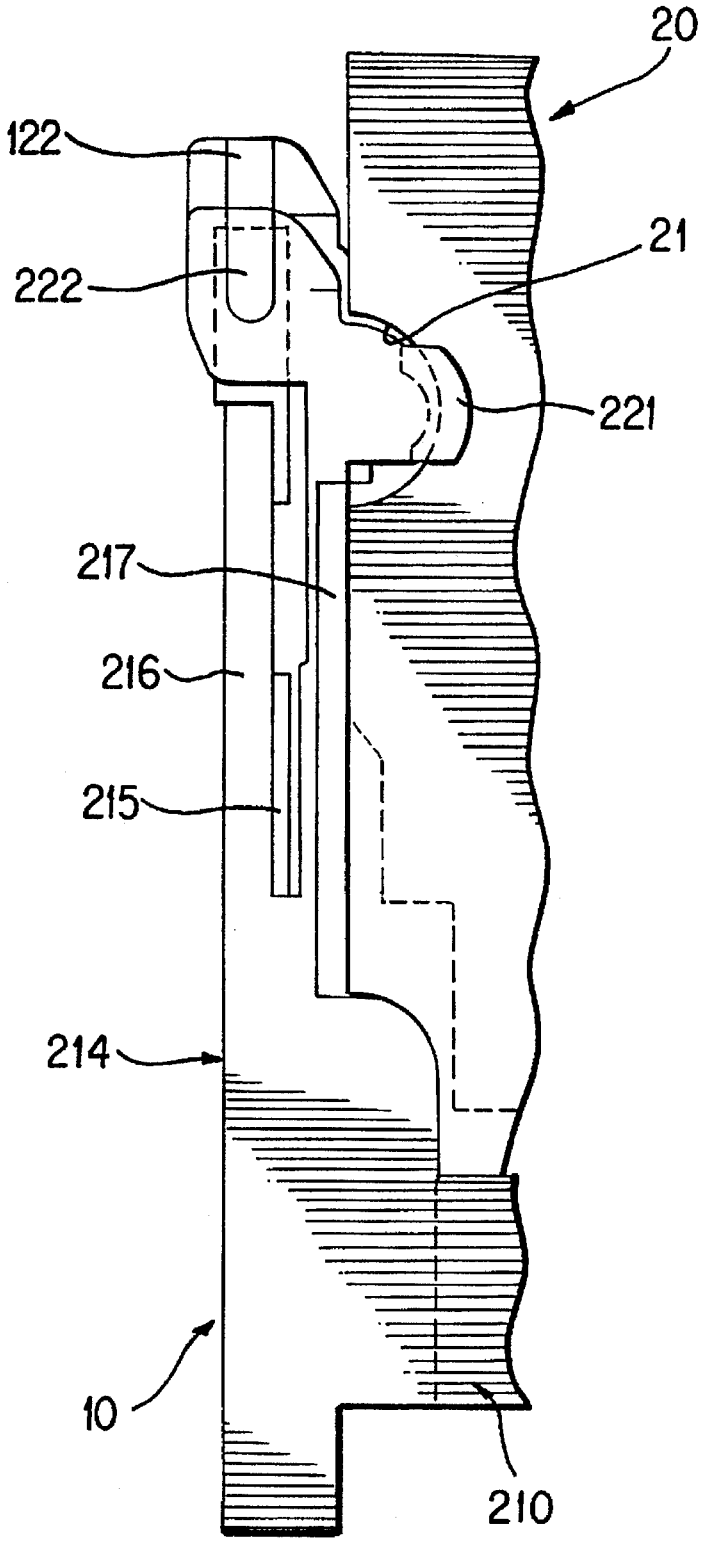
FIG. 4 is a top plan view of a right side wall of the modular board electrical connector to which a modular board is connected.

In FIGS. 3 and 4, the modular board electrical connector 10 to be mounted on a mother board (not shown) is of the horizontal mounting type. By engaging studs 101 extending downwardly from the base 111 of the lower housing 110 with positioning and retaining holes of the mother board it is possible to align the connection sections 161, 171, 261, and 271 of that respective contact elements with corresponding conductors on the mother board. The modular board electrical connector 10 is fixed to the mother board by means of fasteners provided on front portions of fixed arms 116 of the side walls 114 of the lower housing 110 as shown by phantom line in FIG. 3.

First, a modular board 20 is connected into the card receiving slot 112 of the lower housing of the electrical connector 10. That is, a front portion of the modular board 20 is inserted into the card receiving slot 112 diagonally as shown by phantom line so that opposite corners of the front portion of the modular board 20 abut on projections (not shown) provided on opposite sides of the card receiving slot 112. The insertion angle of the modular board 20 is set such a degree that the latch projections 220, the claws 221, and support members 218 provided in the card receiving slot 212 of the upper housing do not become obstacles. By inserting the modular board 20 into the card receiving slot 212 along the tapered surface 218A facing the card receiving slot 112, the latch projections 220 and the claws 221 of the upper housing do not become obstacles.

Then, the modular board 20 is turned to a horizontal position or the support members 118 of the side walls 114 of the lower housing 110 so that both side edges of the modular board 20 abut the latch tabs 121 of the second flexible arms 120. The second flexible arms 120 and the first flexible arms 117 are flexed outwardly to permit both the side edges of the modular board 20 to pass the latch tabs 121. In order to make it easy for the modular board 20 to pass the latch tabs 121, it is preferred to taper the inner surface of each latch tab 121.

When the modular board 20 is supported by the support members 118 of the side walls 114 of the lower housing 110, the first and second flexible arms 117 and 120 return to the original positions so that the latch tabs 121 hold the side edges of the modular board 20 as shown by solid line in FIG. 3. Under such a connection condition, the modular board 20 is held between the support member 118 and the latch tabs 121 in the horizontal position. The modular board 20 is prevented from coming off forwardly and locked by engagement between the abutment surface 21A of the notch 21 in the modular board 20 and the second flexible arms 120 of the lower housing 110. The contact pads on the modular board 20 are brought into contact with the contact sections 163 and 173 of the first and second type contact elements 160 and 170 which are arranged in the card receiving slot 112 of the lower housing 110.

Then, another modular board 20 is connected into the card receiving slot 212. That is, a front portion of the modular board 20 is inserted diagonally into the card receiving slot 212 so that opposite sides of the front end of the modular board 20 abut against projections (not shown) provided on opposite sides of the card receiving slot 212 as shown by phantom line. Then, the modular board 20 is turned to a horizontal position or the support member 218 of the side walls 214 of the upper housing 210 so that the modular board 20 abut against the claws 221 of the third flexible arm 217. The third flexible arm is then flexed outwardly to permit the modular board 20 to pass the claws 221. In order to make it easy for the modular board 20 to pass the claws 221, it is preferred to taper the inner surface of the claws 221.

When the modular board 20 rests on the support surface 218 of the upper housing 210, the third flexible arms 217 return to the original position so that the claws 221 hold the modular board 20 on the both sides as shown by solid line in FIG. 3 and FIG. 4. Under such a connection condition, the modular board 20 is held between the support members 218 and the latch claws 221 in the horizontal position. The modular board 20 is prevented from coming off forwardly and locked by engagement between the abutment surface 21A of the notch 21 and the retaining surface 220A of the retainer projections 220 provided below the latch claws 221 of the third flexible arms 217. The contact pads of the modular board 20 are brought into contact with the contact sections 263 and 273 of the first and second type contact elements 260 and 270 arranged in the card receiving slot 212 of the upper housing 210.

To remove the modular board 20 from the upper housing, the operation levers 222 of the upper housing 210 are flexed outwardly to release the latch claws 221 from the modular board 20 so that the modular board 20 is turned upwardly by spring forces of the first and second type contact elements 260 and 270. Then, the modular board 20 is pulled out from the card receiving slot 212. To remove the modular board 20 from the lower housing 110, the operation levers 122 are flexed outwardly to release the latch tabs 121 from the modular board 20 so that the modular board 20 is turned upwardly by spring forces of the first and second contact elements 160 and 170. Thus, the modular board 20 can be pulled out from the card receiving slot 212.

Figure 5:
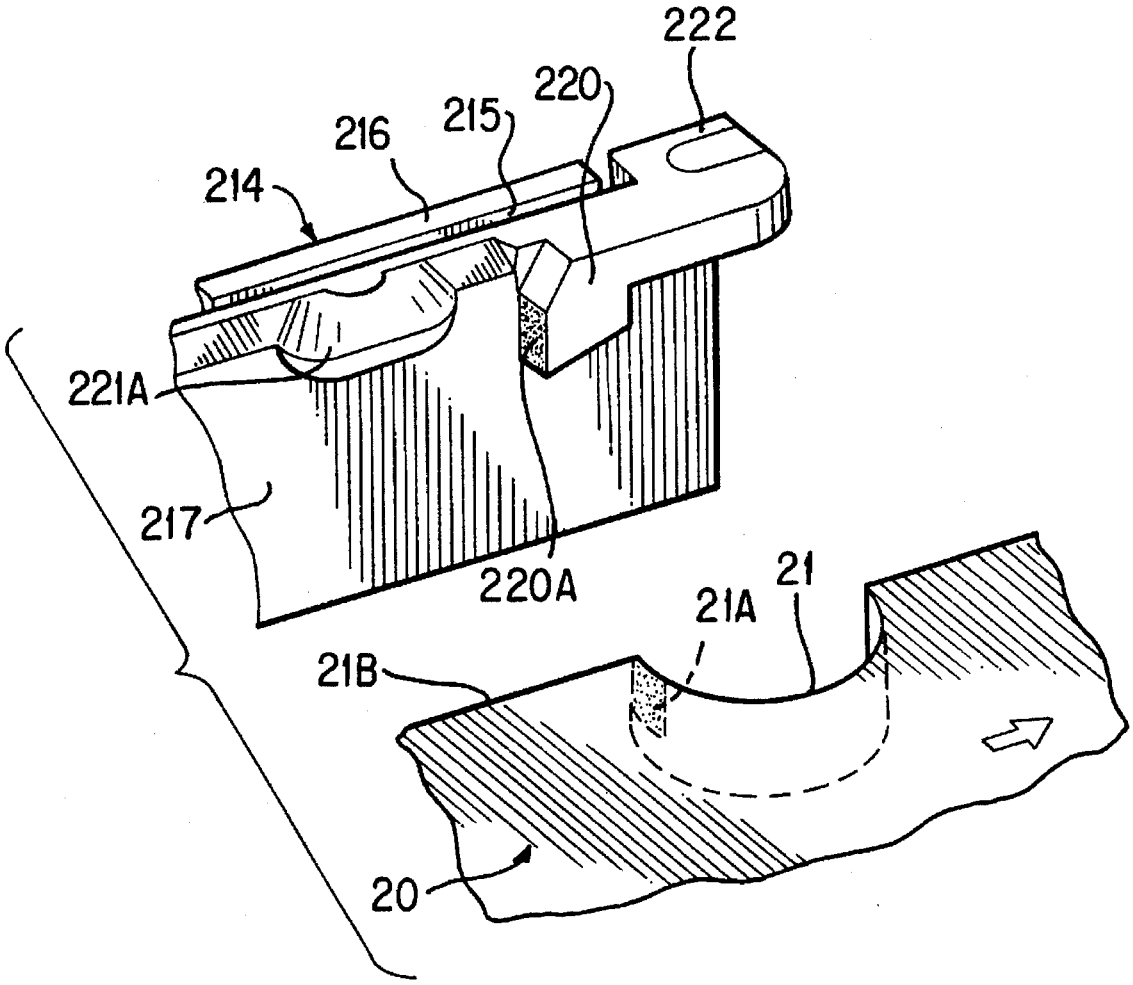
FIG. 5 is a perspective view of an upper right side wall of a modular board electrical connector according to another embodiment of the invention.

In FIG. 5, the latch claws 221 of the third flexible arms 217 are replaced by retaining projections 221A provided on the third flexible arms 217 closer to the base 211 than the retention surface 220A of the projections 220. The projections 221A are provided with a tapered surface to facilitate the side edges 21B of the modular board 20 to pass the retaining projections 221A. The retaining projections 221A hold the side edges 21B of the modular board 20 and produce the same results as those of the latch claws in FIG. 2.

The latch tabs 121 of the lower housing 110 are movable by means of the first and second flexible arms 117 and 120, thus providing a soft latch action. By contrast, the latch claws 221 of the upper housing 210 are provided directly on the third flexible arms 217 and provide a hard latch action. Consequently, the latch claws 221 are subjected to large stresses and prone to damage unless they are made strong. By contrast, such retaining projections 221A as shown in FIG. 5 are more resistant to damage.

The modular board electrical connector may have three or more housings stacked one upon another.

With the modular board electrical connector according to the invention, the position of the latch tabs for the upper housing are retreated more than the position of latch tabs of the lower housing so that the latch tabs of the upper housing are not in the way for a modular board being inserted into the lower housing even with only a small gap left between the upper and lower housings. Thus, it is possible to connect the modular boards with high density or minimize the size of the modular board electrical connector.

By the latch tabs for the card receiving slot of the lower housing are provided on the second flexible arms which are connected to the first flexible arms it is possible to not only make low-file the latch members for the lower housing but also provide sufficiently large opening to receive the side edges of a modular board with satisfactory strength. Since the latch tabs for the card receiving slot of the upper housing are provided on the third flexible arms, the latch tabs of the upper housing are not in the way for the modular board being inserted into the card receiving slot of the lower housing, thus minimizing the gap between the upper and lower housings. As a result, the thickness of the modular board electrical connector can be minimized.

The card receiving slot and the support members of the upper housing are retreated more than the card receiving slot and the support members of the lower housing so that the thickness of the modular board electrical connector can be minimized. Since the support members are provided with tapered surfaces facing the card receiving slot of the lower housing, the thickness of the modular board electrical connector can be further minimized.

What is claimed is:

1. A modular board electrical connector to be mounted on a common board comprising:

first and second insulation housings stacked one upon another parallel to said common board and having first and second bases with first and second card receiving slots therein and first and second pairs of side walls extending forwardly from opposite ends of said first and second bases and having first and second latch members on free ends thereof;

a plurality of contact elements arranged in said first and second card receiving slots such that when a modular board is inserted into said first or second card receiving slot and turned to a latch position, they are brought into contact with contact pads of said modular board;

a pair of support members extending forwardly from opposite ends of each of said card receiving slots along said side walls for supporting said modular board inserted in said card receiving slot; and said latch members of said first insulation housing being retreated from those of said second insulation housing thereby facilitating diagonal insertion of a modular board into said card receiving slot of said second insulation housing.

2. A modular board electrical connector, comprising:

first and second insulation housings stacked one upon another and having first and second bases with first and second card receiving slots therein and first and second pairs of side walls extending forwardly from opposite ends of said first and second bases and having first and second latch members on free ends thereof;

a plurality of contact elements arranged in said first and second card receiving slots such that when a modular board is inserted into said first or second card receiving slot and turned to a latch position, they are brought into contact with contact pads of said modular board;

a pair of support members extending forwardly from opposite ends of each of said card receiving slots along said side walls for supporting said modular board inserted in said card receiving slot; and said latch members of said first insulation housing being retreated from those of said second insulation housing thereby facilitating diagonal insertion of a modular board into said card receiving slot of said second insulation housing, wherein said second side walls comprise:

a first fixed arm;

a first flexible arm extending along said fixed arm;

a second flexible arm extending inwardly and then rearwardly from said first flexible arm and supporting said second latch member, and said first side walls comprise:

a second fixed arm; and a third flexible arm extending along said second fixed arm for supporting said first latch member.

3. A modular board electrical connector according to claim 1, wherein said support members of said first insulation housing have a tapered surface facing said second card receiving slot.

* * * * *